US007783480B2

(12) United States Patent
Yoshida

(10) Patent No.: US 7,783,480 B2
(45) Date of Patent: Aug. 24, 2010

(54) AUDIO ENCODING APPARATUS, AUDIO DECODING APPARATUS, COMMUNICATION APPARATUS AND AUDIO ENCODING METHOD

(75) Inventor: Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 708 days.

(21) Appl. No.: 11/574,783

(22) PCT Filed: Sep. 15, 2005

(86) PCT No.: PCT/JP2005/017053

§ 371 (c)(1),
(2), (4) Date: Mar. 6, 2007

(87) PCT Pub. No.: WO2006/030864

PCT Pub. Date: Mar. 23, 2006

(65) Prior Publication Data

US 2008/0281587 A1 Nov. 13, 2008

(30) Foreign Application Priority Data

Sep. 17, 2004 (JP) ..... 2004-271886

(51) Int. Cl.
*G10L 19/12* (2006.01)
*G10L 19/00* (2006.01)

(52) U.S. Cl. ..... 704/219; 704/221; 704/223

(58) Field of Classification Search ..... None
See application file for complete search history.

(56) References Cited

U.S. PATENT DOCUMENTS 5,920,832 A 7/1999 Wuppermann et al.
6,704,703 B2 * 3/2004 Ferhaoul et al. ..... 704/223
7,406,410 B2 * 7/2008 Kikuiri et al. ..... 704/221
7,606,703 B2 * 10/2009 Unno ..... 704/219

(Continued)

FOREIGN PATENT DOCUMENTS

EP 1158495 11/2001

(Continued)

OTHER PUBLICATIONS

Koishida, K. et al. "A 16-bit/s bandwidth scalable audio coder based on the G.729 standard," Acoustics, Speech, and Signal Processing, 2000. ICASSP '00. Proceedings. 2000 IEEE International Conference on, vol. 2, on pp. II1149-II1152.*

(Continued)

*Primary Examiner*—Matthew J Sked
(74) *Attorney, Agent, or Firm*—Greenblum & Bernstein, P.L.C.

(57) ABSTRACT

An audio encoding apparatus and the like are disclosed which can improve the sound quality of encoded audio signals even in a case of scalable CELP encoding the audio signals in sections that vary with time. In this apparatus, an enhancement layer extended adaptive codebook generating part (102) generates an extended adaptive codebook (d_enh_ext[i]) from both one frame of core layer drive sound source signals (exc_core[n]) received from a core layer CELP encoding part (101) and past enhancement layer drive sound source signals (exc_enh[n]) received from an adder (106), and further inputs the generated extended adaptive codebook (d_enh_ext[i]) to an enhancement layer extended adaptive codebook (103) for each of sub-frames. That is, the enhancement layer extended adaptive codebook generating part (102) updates the extended adaptive codebook (d_enh_ext[i]) for each of the sub-frames.

7 Claims, 7 Drawing Sheets

U.S. PATENT DOCUMENTS

| | | | | |
|---|---|---|---|---|
| 7,702,504 | B2 * | 4/2010 | Son et al. | 704/219 |
| 2002/0052739 | A1 | 5/2002 | Oishi | |
| 2005/0010404 | A1 * | 1/2005 | Son et al. | 704/219 |
| 2005/0163323 | A1 | 7/2005 | Oshikiri | |
| 2006/0173677 | A1 * | 8/2006 | Sato et al. | 704/223 |

FOREIGN PATENT DOCUMENTS

| | | |
|---|---|---|
| EP | 1431962 | 6/2004 |
| JP | 8-123495 | 5/1996 |
| JP | 8-263096 | 10/1996 |
| JP | 11-504491 | 4/1999 |
| JP | 2001-337700 | 12/2001 |
| JP | 2002-140098 | 5/2002 |
| JP | 2003-323199 | 11/2003 |
| JP | 2004-102074 | 4/2004 |
| JP | 2004-138756 | 5/2004 |

OTHER PUBLICATIONS

Kataoka, A. "Scalable Wideband Speech Coding Using G.729 as a Component," IEICE, vol. J86-D-II, No. 3, pp. 379-387 (English Translation).*

Nomura et al., "A bitrate and bandwidth scalable CELP coder", Acoustics, Speech and Signal Processing, 1998. Proceedings of the 1998 IEEE International Conference on Seattle, WA, USA May 12-15, 1998, New York, NY, USA, IEEE, US, vol. 1, May 12, 1998, pp. 341-344, XP010279059.

Kataoka et al., "Scalable Wideband Speech Coding Using G.729 as a Component," Journal of IEICE, D-II, Mar. 2003, vol. J86-D-II, No. 3, pp. 379-387, together with an English language partial translation Thereof.

U.S. Appl. No. 11/576,264 to Goto et al., filed Mar. 29, 2007.

U.S. Appl. No. 11/718,437 to Ehara et al., filed May 2, 2007.

* cited by examiner

AUDIO ENCODING APPARATUS, AUDIO DECODING APPARATUS, COMMUNICATION APPARATUS AND AUDIO ENCODING METHOD

TECHNICAL FIELD

The present invention relates to a speech encoding apparatus for encoding a speech signal using a scalable CELP (Code Excited Linear Prediction) scheme.

BACKGROUND ART

Speech encoding schemes having scalable function (function whereby decoding from partial encoded data is possible on the receiving end) are suitable for traffic control of speech data communications and multicast communications on IP (Internet Protocol) networks. The CELP encoding scheme is a speech encoding scheme enabling high sound quality at a low bit rate, and adjustment of sound quality according to the bit rate is possible by being applied to a scalable encoding scheme.

In CELP encoding of a speech signal, the adaptive codebook (ACB) search (an excitation search employing a past excitation signal, i.e. the adaptive codebook) will have an effect on the sound quality of the encoded speech signal and on the bit rate needed for transmission thereof. In scalable CELP encoding, the effects thereof further increases. Moreover, in scalable CELP encoding, while encoding schemes that do not employ an enhancement layer for an adaptive codebook are known (see, for example, FIG. 3 of Non-Patent Document 1), the use of an adaptive codebook provides generally good sound quality of the encoded speech signal, since past excitation signals continually-updated for optimization can be utilized effectively (see, for example, FIG. 5 of Non-Patent Document 1).

FIG. 1 shows the temporal relationship between a sub-frame targeted for encoding, and the section of the adaptive codebook searched to generate an enhancement layer adaptive excitation candidate vector for the sub-frame targeted for encoding, in the case of an excitation search carried out during CELP encoding for each sub-frame in the enhancement layer. As shown in FIG. 1, the enhancement layer adaptive excitation candidate vector is retrieved by searching a prescribed section of the adaptive codebook, which is an integration of excitation signals preceding in time the sub-frame targeted for encoding in the enhancement layer. The adaptive codebook in the enhancement layer is generated and updated by the following procedure.

(1) Encoding of core layer (2) An adaptive codebook search (pitch prediction) is carried out in the enhancement layer using the core layer excitation, the adaptive excitation lag (pitch cycle T0) of the core layer and the adaptive codebook of the enhancement layer (auxiliary adaptive codebook), and an adaptive excitation is generated from the adaptive codebook (3) A fixed excitation search and gain encoding are carried out in the enhancement layer (4) The adaptive codebook of the enhancement layer is updated using the encoded enhancement layer excitation signal derived through (1) to (3) above.

Non-Patent Document 1: Journal of IEICE, D-II, March 2003, Vol. J86-D-II (No. 3), p. 379-387

DISCLOSURE OF INVENTION

Problems to be Solved by the Invention

However, with the conventional CELP encoding scheme, when the adaptive codebook search in the enhancement layer and encoding are carried out based on an input speech signal of a section exhibiting change over time, e.g. a transient voiced signal or a speech onset segment, the adaptive codebook is an integration of past excitation signals and is not able to handle temporal change in the input speech signal, which results in a problem of the worse sound quality of the encoded speech signal.

It is therefore an object of the present invention to provide a speech encoding apparatus capable of improving sound quality of the encoded speech signal, even in cases where scalable CELP encoding is performed on a speech signal from a section that changes over time.

Means for Solving the Problem

The speech encoding apparatus according to the present invention performs a search of an adaptive codebook of an enhancement layer for each sub-frame in scalable CELP encoding of a speech signal, the speech encoding apparatus comprising a core layer encoding section that generates, for a core layer, a core layer excitation signal, and core layer encoded data that indicates an encoding result of CELP encoding from the speech signal; an enhancement layer extended adaptive codebook generating section that generates, for the enhancement layer, an extended adaptive codebook that includes an enhancement layer excitation signal preceding in time the sub-frame targeted for encoding, and a core layer excitation signals succeeding in time the past enhancement layer excitation signals; and an enhancement layer extended adaptive codebook that generates an enhancement layer adaptive code indicating an adaptive excitation vector for the sub-frame targeted for encoding by searching in the generated extended adaptive codebook.

The speech decoding apparatus in accordance with the present invention decodes scalable CELP-encoded speech data to generate decoded speech, the speech decoding apparatus comprising a core layer decoding section that decodes, for a core layer, encoded core layer data included in the speech encoded data and generates a core layer excitation signal and a decoded core layer speech signal; an enhancement layer extended adaptive codebook generating section that generates, for the enhancement layer, an extended adaptive codebook that includes an enhancement layer excitation signal preceding in time the sub-frame targeted for decoding and a core layer excitation signal succeeding in time the past enhancement layer excitation signals; and an enhancement layer extended adaptive codebook that extracts from the generated extended adaptive codebook an adaptive excitation vector for the sub-frame targeted for decoding.

Advantageous Effect of the Invention

According to the present invention, in cases where the adaptive codebook search in the enhancement layer and encoding for each of the sub-frames are carried out based on speech signals of a section exhibiting change over time, e.g. a transient voiced signal or a speech onset segment, since the adaptive codebook is constituted to include not only the conventional adaptive codebook which is an integration of past excitation signals of the enhancement layer, but also core layer excitation signals indicating change in the speech signal succeeding in time the sub-frame targeted for encoding, the excitation of the sub-frame targeted for encoding can be estimated reliably, and the sound quality of the encoded speech signal improved as a result.

BEST MODE FOR CARRYING OUT THE INVENTION

Now, embodiments of the present invention will be described below in detail with reference to the accompanying drawings.

Embodiment 1

Embodiment 1 according to the present invention describes a mode wherein a speech signal is subjected to CELP encoding, and the adaptive codebook searched for the excitation in the enhancement layer includes not only the conventional adaptive codebook which is an integration of past excitation signals of the enhancement layer, but also core layer excitation signals indicating change in the speech signal succeeding in time the sub-frame targeted for encoding. The present embodiment assumes that scalable CELP encoding of the speech signal is carried out under the following conditions.

(1) Two layers scalable encoding scheme of a core layer/enhancement layer (2) Sampling frequency in the core layer and the enhancement layer is the same (no band expansion between the two layers)

(3) In the excitation search of the enhancement layer, when searching the adaptive codebook, the differential between the core layer excitation signal and the adaptive excitation generated from the adaptive codebook is encoded (4) The LPC parameter is the same for the core layer and the enhancement layer (5) CELP encoding for both the core layer and the enhancement layer is executed in sub-frame units (6) The excitation search in CELP encoding of the enhancement layer is executed after CELP encoding of the core layer is completed for all sub-frames in a single frame.

Figure 1:
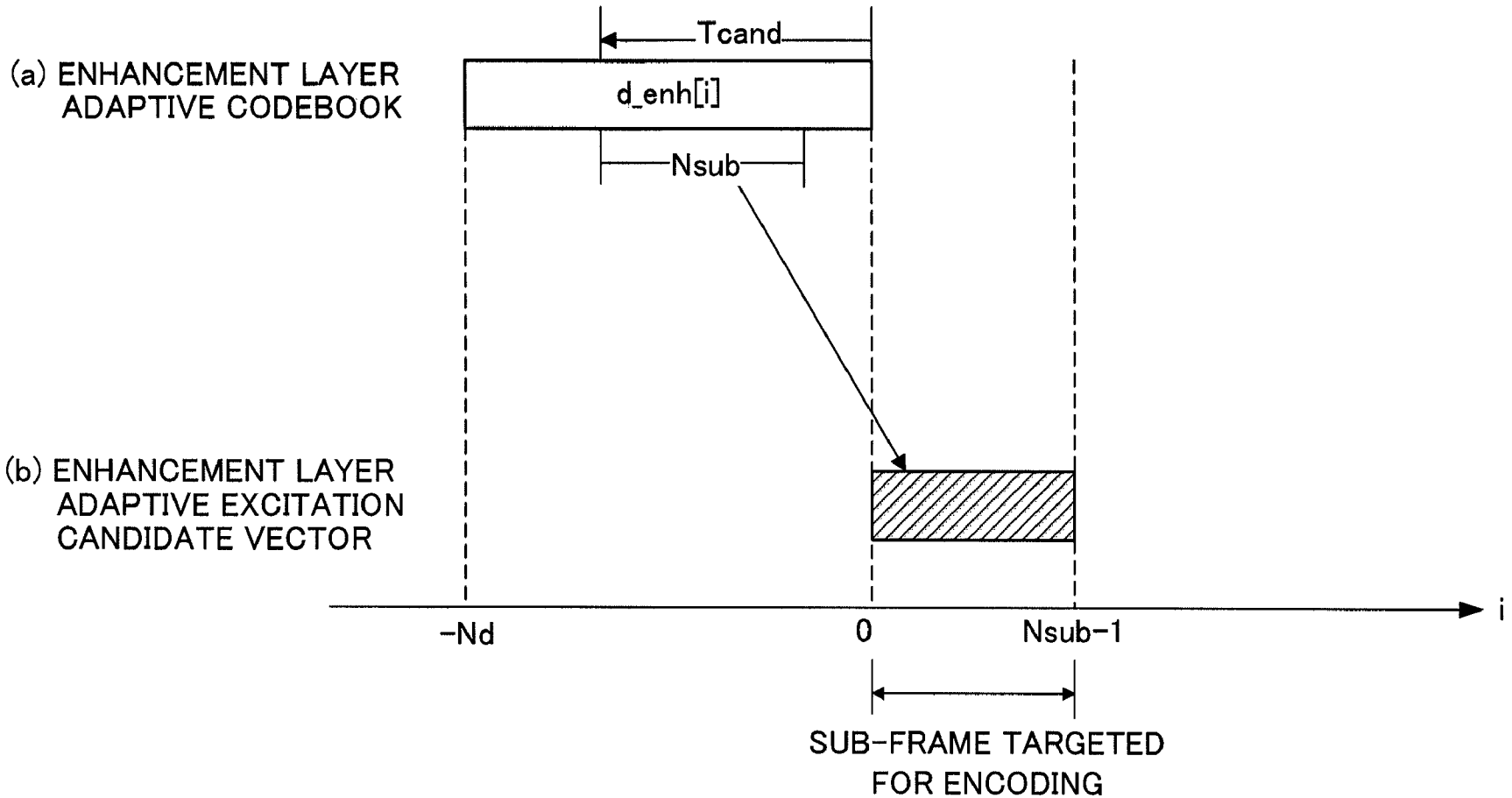
PRIOR ART FIG.1
FIG. 1 is a diagram schematically showing the mode of generating and updating the conventional adaptive codebook.
Figure 2:
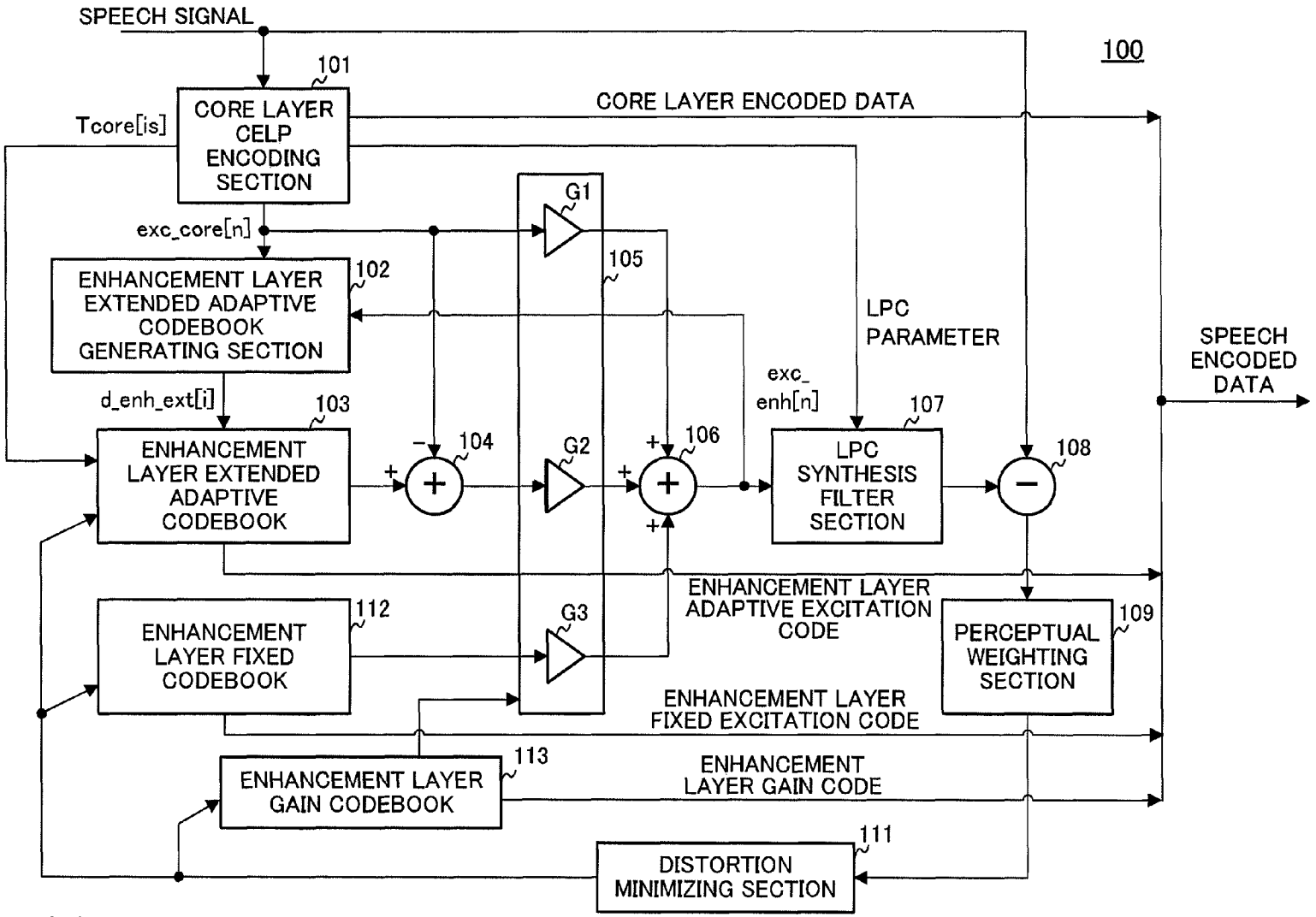
FIG. 2 is a block diagram showing a main configuration of a speech encoding apparatus according to Embodiment 1.

FIG. 2 is a block diagram showing a main configuration of speech encoding apparatus 100 according to Embodiment 1. Speech encoding apparatus 100 is used installed in a mobile station apparatus or base station apparatus making up a mobile wireless communication system.

Speech encoding apparatus 100 comprises core layer CELP encoding section 101, enhancement layer extended adaptive codebook generating section 102, enhancement layer extended adaptive codebook 103, adders 104 and 106, gain multiplying section 105, LPC synthesis filter section 107, subtractor 108, perceptual weighting section 109, distortion minimizing section 111, enhancement layer fixed codebook 112, and enhancement layer gain codebook 113.

Core layer CELP encoding section 101 calculates LPC parameters (LPC coefficients), which are spectrum envelope information by carrying out linear prediction analysis on an input speech signal, and performs quantization of the calculated LPC parameter for output to LPC synthesis filter section 107. Core layer CELP encoding section 101 also performs CELP encoding of the core layer of the input speech signal, and generates a core layer excitation signal exc_core[n] (n=0, . . . , Nfr−1) (Nfr: frame length) and an adaptive excitation lag Tcore[is] (is=0, . . . , ns−1) (ns: the number of sub-frames) for all of the sub-frames within a single frame, inputs this core layer excitation signal exc_core[n] to enhancement layer extended adaptive codebook generating section 102, adder 104, and multiplier G1 in gain multiplying section 105, and then inputs the adaptive excitation lag Tcore[is] to enhancement layer extended adaptive codebook 103. Core layer CELP encoding section 101 also generates encoded core layer data by CELP encoding in the core layer, and inputs the generated encoded core layer data to a multiplexing section (not illustrated).

Enhancement layer extended adaptive codebook generating section 102 generates an extended adaptive codebook d_enh_ext[i] from one frame of core layer excitation signals exc_core[n] inputted from core layer CELP encoding section 101, and past enhancement layer excitation signals inputted from adder 106, then inputs the generated extended adaptive codebook d_enh_ext[i] to enhancement layer extended adaptive codebook 103, for each of the sub-frames. That is, enhancement layer extended adaptive codebook generating section 102 updates the extended adaptive codebook d_enh_ext[i] for each of the sub-frames. In this process of updating for each of the sub-frames, only past enhancement layer excitation signals corresponding to the conventional adaptive codebook in the enhancement layer are updated. The generation mode of the extended adaptive codebook in enhancement layer extended adaptive codebook generating section 102 will be discussed in detail later.

Enhancement layer extended adaptive codebook 103 performs an excitation search in CELP encoding of the enhancement layer in sub-frame units using the adaptive excitation lag Tcore[is] inputted from core layer CELP encoding section 101, and the extended adaptive codebook d_enh_ext[i] inputted from enhancement layer extended adaptive codebook generating section 102 in accordance with an instruction from distortion minimizing section 111. Specifically, enhancement layer extended adaptive codebook 103 generates an adaptive excitation corresponding to an index specified by distortion minimizing section 111 for only a certain prescribed section in the extended adaptive codebook d_enh_ext[i] inputted from enhancement layer extended adaptive codebook generating section 102, i.e. a section determined on the basis of the time interval of the value of the adaptive excitation lag Tcore[is] inputted from core layer CELP encoding section 101 or of the cumulative value thereof (adaptive excitation lag candidate), and inputs the generated adaptive excitation to adder 104.

Adder 104 calculates a differential signal for the adaptive excitation inputted from enhancement layer extended adaptive codebook 103 and the core layer excitation signal of the corresponding sub-frame inputted from core layer CELP encoding section 101, and inputs the calculated differential signal to multiplier G2 in gain multiplying section 105.

Enhancement layer fixed codebook 112 stores a plurality of excitation vectors (fixed excitations) of prescribed shape in advance, and inputs to multiplier G3 in gain multiplying section 105 a fixed excitation corresponding to the index specified by distortion minimizing section 111.

In accordance with an instruction from distortion minimizing section 111, enhancement layer gain codebook 113 generates gain for the core layer excitation signal exc_core[n] inputted from core layer CELP encoding section 101, gain for the differential signal inputted from adder 104, and gain for the fixed excitation, and inputs each of the generated gains to gain multiplying section 105.

Gain multiplying section 105 has multipliers G1, G2, G3. In multiplier G1, the core layer excitation signal exc_core[n] inputted from core layer CELP encoding section 101 is multiplied by gain value g1; similarly, in multiplier G2 the differential signal inputted from adder 104 is multiplied by gain value g2, and in multiplier G3 the fixed excitation inputted from enhancement layer extended adaptive codebook generating section 102 is multiplied by gain value g3, with all three of these multiplication results being inputted to adder 106.

Adder 106 adds the three quantized multiplication results inputted from gain multiplying section 105, and inputs the addition result, i.e. the enhancement layer excitation signal, to LPC synthesis filter section 107.

LPC synthesis filter section 107 generates a synthesized speech signal from the enhancement layer excitation signal inputted from adder 106 by a combining filter having as filter coefficients the quantized LP parameter inputted from core layer CELP encoding section 101, and inputs the generated enhancement layer excitation signal to subtractor 108.

Subtractor 108 generates an error signal by subtracting the enhancement layer synthesized speech signal inputted from combining filter section 107 using input speech signal, and inputs this error signal to perceptual weighting section 109. This error signal corresponds to encoding distortion.

Perceptual weighting section 109 applies perceptual weighting on the encoding distortion inputted from subtractor 108, and inputs this weighted encoding distortion to distortion minimizing section 111.

Distortion minimizing section 111 obtains, for each sub-frame, indices of enhancement layer extended adaptive codebook 103, enhancement layer fixed codebook 112, and enhancement layer gain codebook 113 so as to minimize the encoding distortion inputted from perceptual weighting section 109; reports these indices to enhancement layer extended adaptive codebook 103, enhancement layer fixed codebook 112, and enhancement layer gain codebook 113 respectively; and inputs an enhancement layer adaptive excitation signal, an enhancement layer fixed excitation signal, and an enhancement layer gain excitation signal as speech encoded data to the multiplexing section (not illustrated) via these codebooks.

Next, the multiplexing section, a transmitting section and the like (not illustrated) subject the encoded core layer data inputted from core layer CELP encoding section 101 to packetization in frame units; subject the enhancement layer adaptive excitation code inputted from enhancement layer extended adaptive codebook 103, the enhancement layer gain code inputted from enhancement layer gain codebook 113, and the enhancement layer fixed excitation code inputted from enhancement layer fixed codebook 112 to packetization in frame units; and wirelessly transmit, at separate timing, packets containing the encoded core layer data and packets containing the enhancement layer adaptive excitation code.

The enhancement layer adaptive excitation signal with minimum encoding distortion, is fed back to enhancement layer extended adaptive codebook generating section 102, for each of the sub-frames.

Enhancement layer extended adaptive codebook 103 is used for representing components with a strong periodic nature, such as speech; while enhancement layer fixed codebook 112 used for representing components with a weak periodic nature, such as white noise.

Figure 3:
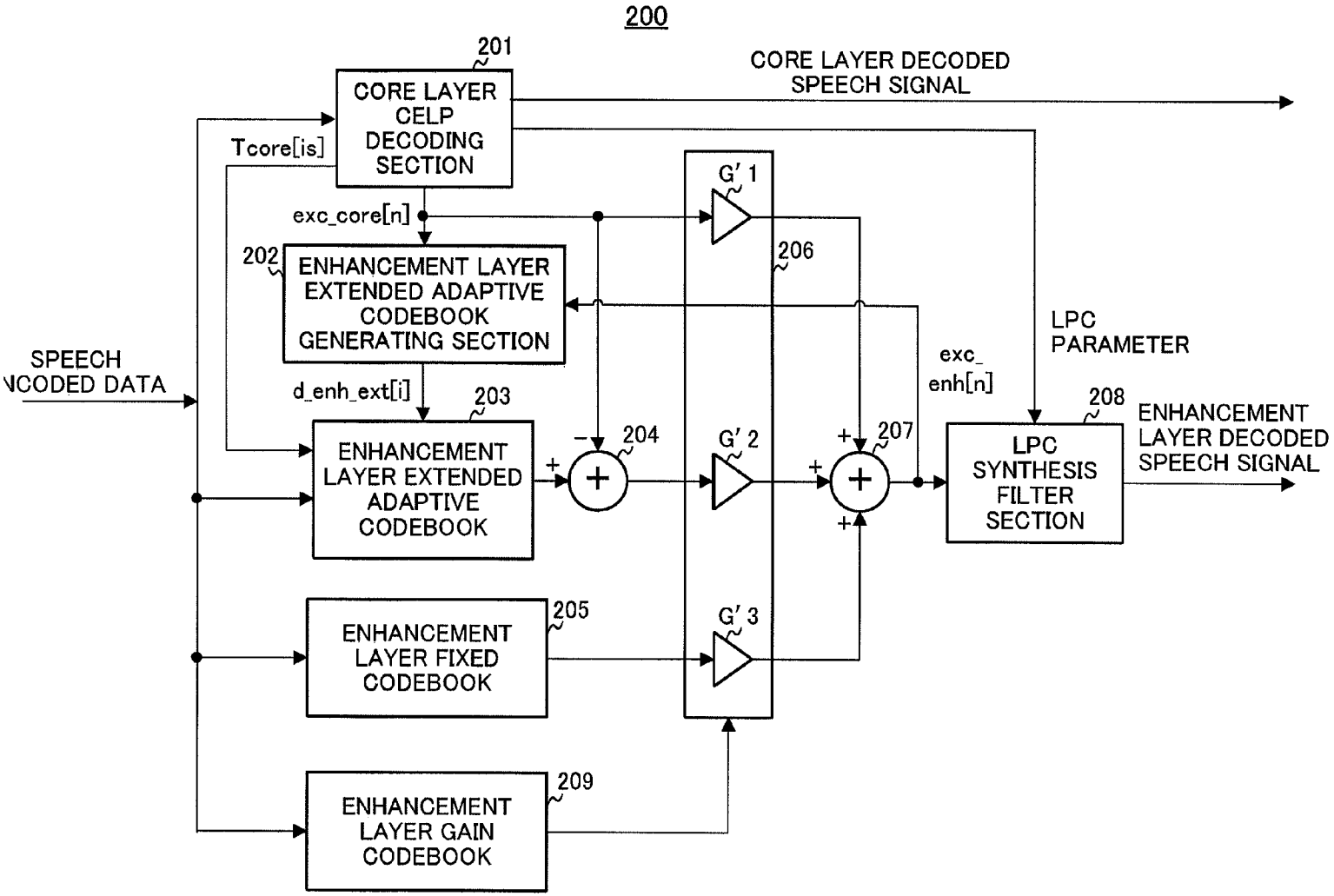
FIG. 3 is a block diagram showing a main configuration of a speech decoding apparatus according to Embodiment 1.

FIG. 3 is a block diagram showing a main configuration of speech decoding apparatus 200 according to Embodiment 1. Speech decoding apparatus 200 is an apparatus for decoding speech signals from speech encoded data by scalable CELP encoding by speech encoding apparatus 100; and used installed in a mobile station apparatus or base station apparatus making up a mobile wireless communication system similar to speech encoding apparatus 100.

Speech decoding apparatus 200 comprises core layer CELP decoding section 201, enhancement layer extended adaptive codebook generating section 202, enhancement layer extended adaptive codebook 203, adders 204, 207, enhancement layer fixed codebook 205, enhancement layer gain codebook 209, gain multiplying section 206, and LPC synthesis filter section 208. Speech decoding apparatus 200 includes the cases of decoding core layer decoded speech signals, and decoding enhancement layer decoded speech signals.

First, in the case of decoding a core layer decoded speech signal, in core layer CELP decoding section 201, the core layer encoded data is extracted from the speech encoded data from a receiving section (not illustrated) having been encoded by scalable CELP encoding by speech encoding apparatus 100; and on the basis of the extracted core layer encoded data, CELP decoding is performed in the core layer, generating a core layer decoded speech signal for output.

On the other hand, in the case of decoding an enhancement layer decoded speech signal, in the process of CELP decoding in core layer CELP decoding section 201, there are respectively generated a quantized LPC parameter, one frame of core layer excitation signals exc_core[n] and one frame of adaptive excitation lags Tcore[is]. Core layer CELP decoding section 201 inputs the quantized LPC parameter to LPC synthesis filter section 208. Also, core layer CELP decoding section 201 inputs this core layer excitation signal exc_core [n] to enhancement layer extended adaptive codebook generating section 202, adder 204, and multiplier G'1 in gain multiplying section 206, and then inputs this adaptive excitation lag Tcore[is] to enhancement layer extended adaptive codebook 203.

Enhancement layer extended adaptive codebook generating section 202 generates for each of the sub-frames an extended adaptive codebook d_enh_ext[i] from one frame of core layer excitation signals exc_core[n] inputted from core layer CELP decoding section 201, and past enhancement layer excitation signals exc_enh[n] inputted for each of the sub-frames from adder 207; and inputs the generated extended adaptive codebook d_enh_ext[i] to enhancement layer extended adaptive codebook 203. That is, enhancement layer extended adaptive codebook generating section 202 updates the extended adaptive codebook d_enh_ext[i] for each of the sub-frames.

On the basis of the enhancement layer adaptive excitation code in the speech encoded data from a receiving section (not illustrated) having been encoded by scalable CELP encoding by speech encoding apparatus 100, adaptive excitation lag Tcore[is] inputted from core layer CELP decoding section 201, and extended adaptive codebook d_enh_ext[i] inputted from enhancement layer extended adaptive codebook generating section 202, enhancement layer extended adaptive codebook 203 generates an adaptive excitation, and inputs the generated adaptive excitation to adder 204.

Adder 204 inputs to multiplier G'2 in gain multiplying section 206 a differential signal of the adaptive excitation inputted from enhancement layer extended adaptive codebook 203 and the core layer excitation signal inputted from core layer CELP decoding section 201.

Enhancement layer fixed codebook 205 extracts the enhancement layer fixed excitation code contained in the speech encoded data from the receiving section (not illustrated) having been encoded by scalable CELP encoding by speech encoding apparatus 100. Enhancement layer fixed codebook 205 stores a plurality of excitation vectors (fixed excitations) of prescribed shape, generates a fixed excitation corresponding to the acquired fixed excitation code, and inputs the generated fixed excitation to multiplier G'3 in gain multiplying section 206.

Enhancement layer gain codebook 209 generates gain values g1, g2, g3 used in gain multiplying section 105 from the enhancement layer gain code contained in the speech encoded data from the receiving section (not illustrated) having been encoded by scalable CELP encoding by speech encoding apparatus 100; and inputs the generated gain values g1, g2, g3 to gain multiplying section 206.

Then, gain multiplying section 206, in multiplier G'1, multiplies the gain value g1 obtained in multiplier G'1 by the core layer excitation signal exc_core[n] inputted from core layer CELP encoding section 201, and, similarly, in multiplier G2, multiplies gain value g2 by the differential signal inputted from adder 204, and multiplies gain value g3 by the fixed excitation inputted from enhancement layer fixed codebook 205, with these three multiplication results being inputted to adder 207.

Adder 207 adds the three multiplication results inputted from gain multiplying section 206, and inputs the addition result, i.e. the enhancement layer excitation signal, to enhancement layer extended adaptive codebook generating section 202 and LPC synthesis filter section 208 respectively.

LPC synthesis filter section 208 generates synthesized decoded speech from the enhancement layer excitation signal, and outputs the generated enhancement layer decoded speech signal.

Next, operation of the speech encoding apparatus 100 will be described with reference to FIGS. 4 to 6.

Figure 4:
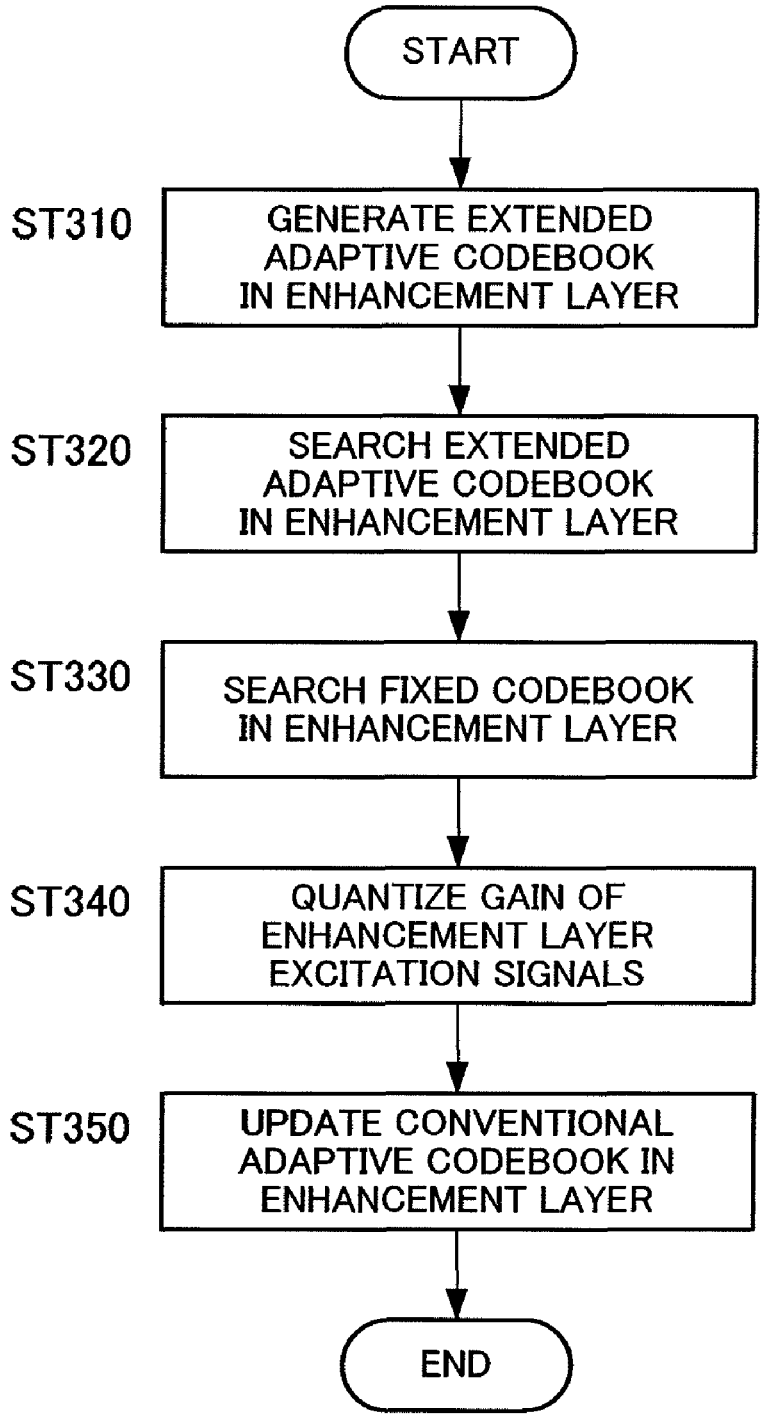
FIG. 4 is a flowchart showing the flow of generating and updating the extended adaptive codebook in Embodiment 1.

FIG. 4 is a flowchart showing, in speech encoding apparatus 100, the flow of one cycle (one sub-frame cycle) of the excitation search, from generation of the extended adaptive codebook in enhancement layer extended adaptive codebook generating section 102, until the extended adaptive codebook is ultimately updated in enhancement layer extended adaptive codebook generating section 102. Further, FIG. 5 schematically shows the mode of generating the extended adaptive codebook from core layer excitation signals and the conventional adaptive codebook, and further generating enhancement layer adaptive excitation candidate vectors (corresponding to adaptive excitations) from a prescribed section of the generated extended adaptive codebook.

In Step ST310 shown in FIG. 4, enhancement layer extended adaptive codebook generating section 102 generates an extended adaptive codebook on the basis of past enhancement layer excitation signals and one frame of core layer excitation signals inputted from core layer CELP encoding section 101. Here, the extended adaptive codebook d_enh_ext[i] for searching during the excitation search in scalable CELP encoding for a sub-frame targeted for encoding having the speech signal sub-frame number [is] is represented by (Equation 1) below.

$$\begin{aligned} \text{d_enh_ext}[i] &= \text{d_enh}[i] \ (\text{for } -Nd \leqq i < 0) \\ &\quad \text{exc_core}[\text{is} * Nsub + i] \\ &\quad (\text{for } 0 \leqq i < Nfr - \text{is} * Nsub) \end{aligned} \qquad \text{(Equation 1)}$$

Here:

d_enh[i]: conventional adaptive codebook in enhancement layer exc_core[i]: excitation signal in core layer Nsub: sub-frame length Nfr: frame length (Nfr=Nsub*ns: number of sub-frame per frame)

Figure 5:
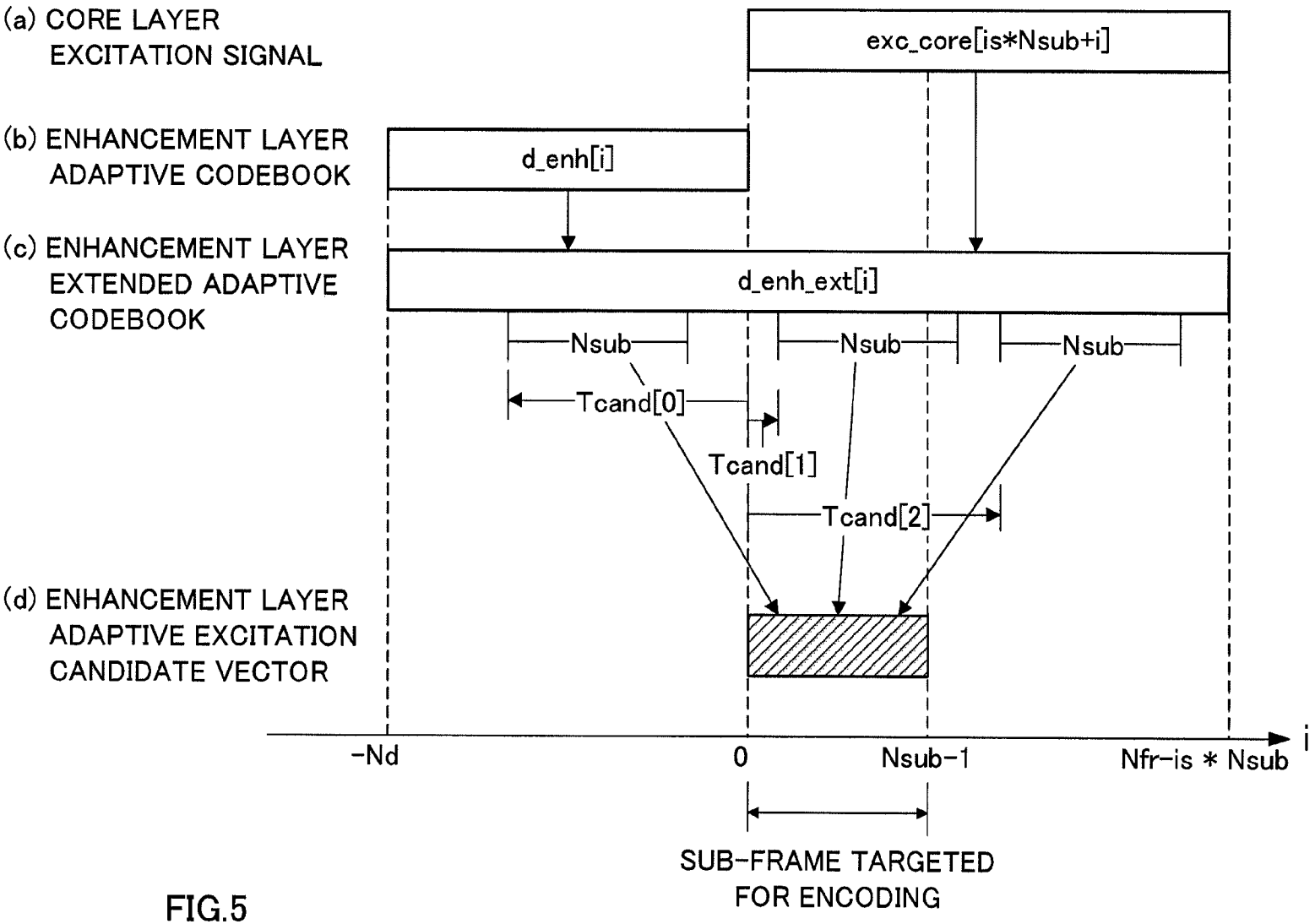
FIG. 5 is a diagram schematically showing the mode of generating or searching the extended adaptive codebook in Embodiment 1.

The significance of (Eq. 1) is schematically shown by the fields of (a) core layer excitation signal, (b) enhancement layer adaptive codebook, and (c) enhancement layer extended adaptive codebook in FIG. 5.

Then, the extended adaptive codebook search, fixed codebook search, and gain quantification from Step ST320 to Step ST340 are carried out sequentially. Here, the enhancement layer excitation signal exc_enh[n] (n=0, . . . , Nsub−1) in a sub-frame targeted for encoding having the speech signal sub-frame number [is] is represented by (Eq. 2) below.

$$\begin{aligned} \text{exc_enh}[n] &= g1 * \text{exc_core}[\text{is} * Nsub + n] + \\ &\quad g2 * \{\text{d_enh_ext}[n - Tenh] - \text{exc_core}[\text{is} * Nsub + n]\} + \\ &\quad g3 * \text{c_enh}[n] \end{aligned} \qquad \text{(Equation 2)}$$

Here:

g1, g2, g3: gain values c_enh[n]: fixed excitation

Tenh: adaptive excitation lag value in enhancement layer

In the present embodiment, in succession, Tenh is determined by the extended adaptive codebook search, c_enh[n] by the fixed codebook search, and g1, g2, g3 by gain quantization.

In Step ST320, the extended adaptive codebook search is performed. First, in enhancement layer extended adaptive codebook 103, there are output enhancement layer adaptive excitation candidate vectors for a prescribed section of the extended adaptive codebook inputted from enhancement layer extended adaptive codebook generating section 102. Then, as the adaptive excitation, there is selected the output enhancement layer adaptive excitation candidate vector that minimizes distortion between the input speech signal, and the LPC synthesized signal for the signal derived in gain multiplying section 105 by multiplying respectively the core layer excitation signals and the differential signals calculated by adder 104 representing a differential from the core layer excitation signal inputted from core layer CELP encoding section 101 by respective gain, and then by adding in adder 106 (this corresponds to the sum of the first and second term on the right side in (Equation 2)). Then, the corresponding adaptive excitation lag Tenh at the time is output, and the differential signal of the selected adaptive excitation and the core layer excitation signal is inputted to gain multiplying section 105.

Here, in calculating Tenh, there can be employed a process of establishing a number of ranges of range ±ΔT centered on an enhancement layer adaptive excitation lag candidate base value Tcand[it] that has been determined utilizing the adaptive excitation lag Tcore[is] of the core layer, and limiting the search to within those ranges, so as to reduce the number of code bits representing the enhancement layer adaptive excitation lag (improve encoding efficiency) and reduce the amount of computations. Tenh may be calculated in fractional accuracy.

$$T\text{enh}=T\text{cand}[\text{it}]-\Delta T-T\text{cand}[\text{it}]+\Delta T \quad \text{it}=0, 1, 2, 3, \qquad \text{(Equation 3)}$$

The enhancement layer adaptive excitation lag candidate base value Tcand[it] is determined, for example, as shown by (Equation 4) below, from the entire possible range for extended adaptive codebook d_enh_ext[i], utilizing the fact that correlation of input signals is high in temporal intervals of the adaptive excitation lag Tcore[j] (j=is, . . . , ns−1) calculated for each of the sub-frames of the core layer, or the cumulative value thereof.

$$\begin{aligned} Tcand\ [\text{it}] &= Tcore\ [\text{is}] && \text{it}=0 \qquad \text{(Equation 4)} \\ &0 && \text{it}=1 \\ &-(Tcand\ [\text{it}-1]+Tcore\ [\text{is}\,0]) && \text{it}>2 \end{aligned}$$

Here, is0 is determined so as to satisfy is 0*Nsub≦is*Nsub+Tcand[it−1]<(is0+1)*Nsub.

The significance of (Equation 2) to (Equation 4) is schematically shown by the fields of (c) enhancement layer extended adaptive codebook and (d) enhancement layer adaptive excitation vector in FIG. 5.

Next, in Step ST330 shown in FIG. 4, a fixed excitation is generated by a fixed excitation search. Specifically, in Step ST330, enhancement layer fixed codebook 112 generates fixed excitation candidate vectors corresponding to indexes specified by distortion minimizing section 111. Then, from these fixed excitation candidate vectors, the core layer excitation signals inputted from core layer CELP encoding section 101, and the differential signals of the core excitation signal and the enhancement layer adaptive excitation selected in Step ST320, there is selected as the fixed excitation c_enh [n] a fixed excitation candidate vector that minimizes the encoding distortion produced by subtractor 108, and this fixed excitation is inputted to gain multiplying section 105.

Next, in Step ST340, in order to carry out gain quantization, in gain multiplying section 105, there are determined gain values g1, g2, g3 that minimize encoding distortion between input speech signals and LPC synthesized signals for signals derived by multiplying the core layer excitation signals inputted from core layer CELP encoding section 101, the differential signals of the core excitation signal and the enhancement layer adaptive excitation selected in Step ST320 and inputted from adder 104, and the fixed excitation selected in Step ST330 and inputted from enhancement layer fixed codebook 112 by respective gain values specified by distortion minimizing section 111 and output by enhancement layer gain codebook 113, followed by addition by adder 106.

Next, in Step ST350, adder 106 adds the three multiplication results obtained by multiplication using gain values g1, g2, g3 derived in Step ST340, and updates the extended adaptive codebook by providing the result of addition as feedback to enhancement layer extended adaptive codebook generating section 102. Here, using the excitation signal exc_enh[n] of the enhancement layer determined after the excitation search of the enhancement layer, the conventional adaptive codebook of the enhancement layer for use in searching in the next sub-frame is updated in accordance with (Equation 5) below.

$$\begin{aligned} &\text{d_enh}\ [i]=\text{d_enh}\ [i+Nsub]\ (\text{for}\ -Nd \leqq i < -Nsub) \qquad \text{(Equation 5)} \\ &\text{exc_enh}\ [i+Nsub]\ (\text{for}\ -Nsub \leqq i < 0) \end{aligned}$$

Figure 6:
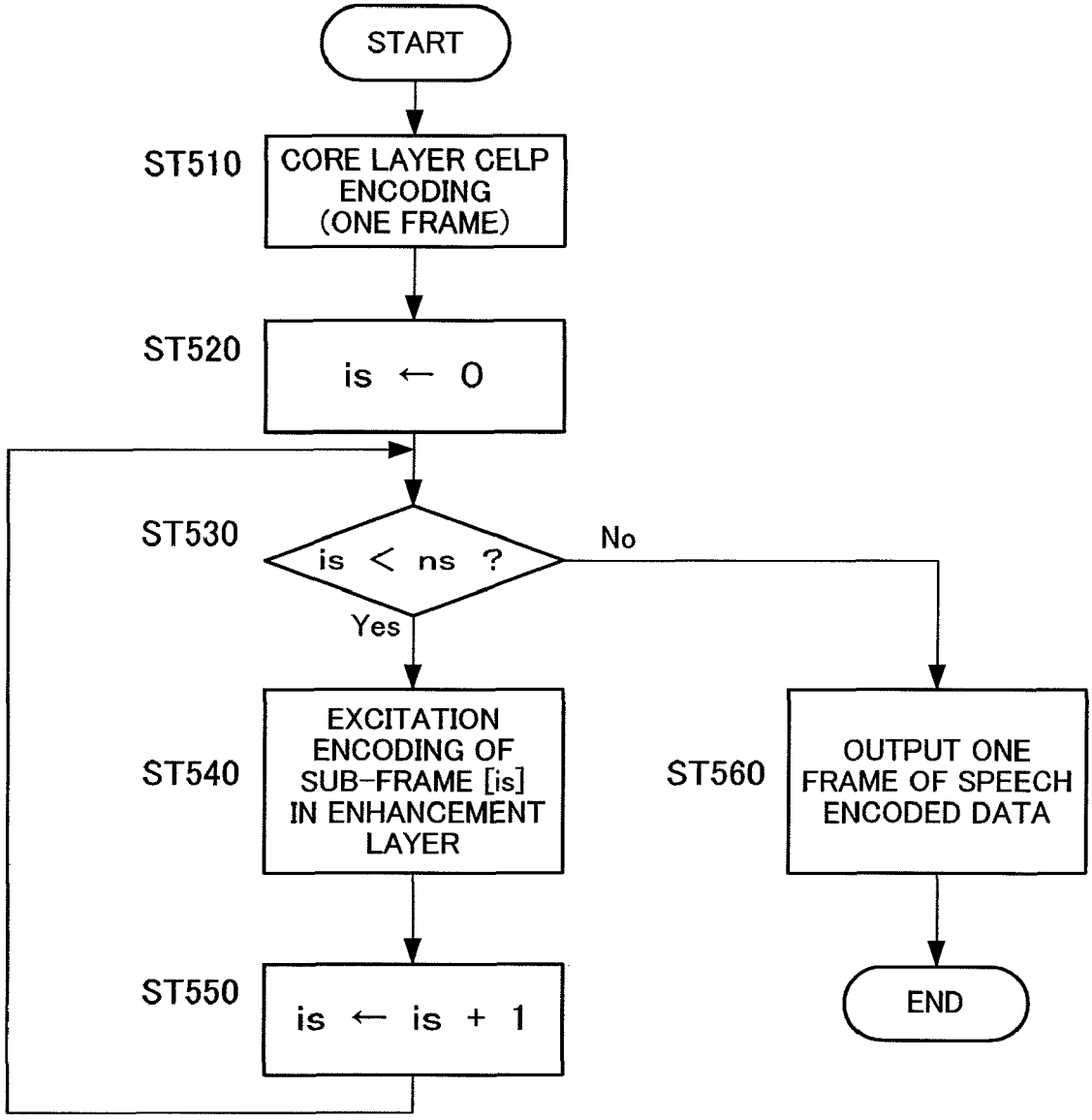
FIG. 6 is a flowchart showing the flow up to the point of packet transmission in frame units of scalable CELP-encoded speech data from the speech decoding apparatus.

FIG. 6 is a flowchart showing the flow of one cycle (one frame cycle) up to the point of wireless transmission of the scalable CELP-encoded speech signal in speech decoding apparatus 100.

In Step ST510, core layer CELP encoding section 101 performs CELP encoding of one frame of the speech signal for the core layer, and inputs the excitation signals obtained through encoding to enhancement layer extended adaptive codebook generating section 102.

Next, in Step ST520, the sub-frame number [is] of the sub-frame targeted for encoding is set to 0.

Next, in Step ST530, it is determined whether it is is<ns (ns: total number of sub-frames in one frame). In the event of a determination of is<ns in Step ST530, Step ST540 is executed next; or in the event of a determination that it is not is<ns, Step ST560 is executed next.

Next, in Step ST540, the steps from Step ST310 to Step ST350 discussed previously are executed sequentially on the sub-frame targeted for encoding having sub-frame number [is].

Next, in Step ST550, the sub-frame number [is] of the next sub-frame targeted for encoding is set to [is+1]. Then, Step ST530 is executed, following Step ST550.

In Step ST560, a transmitting section or the like (not illustrated) in speech encoding apparatus 100 wirelessly transmits packets of the one frame of speech encoded data encoded by scalable CELP to speech decoding apparatus 200.

In this way, according to the present embodiment, in cases where the adaptive codebook search in the enhancement layer and encoding for each of the sub-frames are carried out on speech signals of a section exhibiting change over time, e.g. a transient voiced signal or a voice onset segment, since enhancement layer adaptive codebook 103 is constituted to include not only the conventional adaptive codebook which is an integration of past excitation signals of the enhancement layer, but also core layer excitation signals indicating change in the speech signal succeeding in time the sub-frame targeted d for encoding, the excitation of the sub-frame targeted for encoding can be estimated reliably, and the sound quality of the encoded speech signal can be improved as a result.

Speech encoding apparatus 100 and speech decoding apparatus 200 in the present embodiment may be implemented or modified in ways such as the following.

Whereas the present embodiment described implementation of scalable CELP encoding scheme of two layers in a core layer/enhancement layer, the invention is not limited to such a case, and may be implemented analogously in a scalable CELP encoding scheme of three or more layers, for example. In scalable CELP encoding schemes of N layers, in each of 2 to N layers there may be generated an extended adaptive codebook using core layer excitation signals or enhancement layer excitation signals of the level one level below, i.e. 1 to N−1 layers, as has been done in the enhancement layer of the present embodiment.

Also, whereas the present embodiment described the case where the sampling frequency is the same in both the core layer and the enhancement layer, the invention is not limited to such cases, and, for example, sampling frequency varies appropriately according to the scalable encoding layer; i.e. a band scalable may be applied. To implement a band scalable in speech encoding apparatus 100, an additional low pass filter (LPF) that restricts the band of upsampled core layer excitation signals exc_core [n] could be disposed between the core layer CELP encoding section 101 and the enhancement layer extended adaptive codebook generating section 102; or a core layer local decoder that generates decoded speech signals from core layer excitation signals exc_core[n], the aforementioned upsampling section and LPF (Low Pass Filter), and an inverse filter for regenerating core layer excitation signals exc_core[n] from signals having passed through the LPF could be installed, in that order.

Furthermore, whereas the present embodiment described a case where gain value g1 of multiplier G1 in gain multiplying section 105, i.e. gain value g1 multiplied by core layer excitation signal exc_core[n] is specified by distortion minimizing section 111, the invention is not limited to such cases, with it being possible to fix gain value g1 at 1.0, for example.

Moreover, whereas the present embodiment describes a case where adder 104 inputs to gain multiplying section 105 a differential signal of the adaptive excitation from enhancement layer extended adaptive codebook 103 and the core layer excitation signals, the invention is not limited to such cases, it being possible for the input to gain multiplying section 105 to be any signal indicating a characteristic of the adaptive excitation output from enhancement layer extended adaptive codebook 103. Therefore, it would be possible for example to directly input to gain multiplying section 105 the adaptive excitation outputted from enhancement layer extended adaptive codebook 103, rather than the differential signal described previously. By so doing, adder 104 may be eliminated from speech encoding apparatus 100, and the configuration of speech encoding apparatus 100 can be simplified. In such a case, the enhancement layer excitation signal exc_enh[n] will be represented by the following equation.

$$\text{exc_enh}[n]=g1*\text{exc_core}[is*Nsub+n]+g2*d_\text{enh_ext}[n-T\text{enh}]+g3*c_\text{enh}[n]$$

Also, in this case, gain values g1, g2 in gain multiplying section 105 may be restricted to (g1, g2)=(1,0) or (0,1), i.e. used for switching between core layer excitation signal core_enh[n] and enhancement layer adaptive excitation signal d_enh_ext[n−Tenh].

Furthermore, whereas the present embodiment described a case where the LPC parameter is the same in both the core layer and the enhancement layer, the invention is not limited to such cases, it being possible for example, to quantize an additional quantization component in the enhancement layer in addition to the quantization of the core layer and to use the quantized LPC parameter derived thereby in the enhancement layer. In this case, there will additionally be provided in speech encoding apparatus 100 an enhancement layer LPC parameter quantizing section that inputs the core layer LPC parameter and speech signal, and that outputs the enhancement layer quantized LPC parameter and quantized codes. In the case of implementing of a band scalable, speech encoding apparatus 100 will be provided with an additional LPC analyzing section.

Determination of adaptive excitation lag during search of the extended adaptive codebook in the present embodiment can be carried out by the methods (a) to (c) given below.

(a) Correlation is taken between extended adaptive codebook d_enh_ext[i] and the core layer excitation signal exc_core[n](n=is*Nsub, . . . , is*Nsub+Nsub−1) corresponding to the sub-frame targeted for processing having sub-frame number is; and a plurality of lag values are selected sequentially starting with those that maximize this correlation. Designating these as adaptive excitation lag candidate base values Tcand[it], the adaptive excitation lag search is then carried out in the same manner as in the embodiment.

(b) An LPC prediction residual signal or similar signal is calculated in advance from the speech signal; correlation is taken between extended adaptive codebook d_enh_ext[i] and the LPC prediction residual signal res[n] (n=is*Nsub, . . . , is*Nsub+Nsub−1) corresponding to sub-frame targeted for processing having sub-frame number [is]; and a plurality of lag values are selected sequentially starting with those that maximize this correlation. Designating these as adaptive excitation lag candidate base values Tcand[it], the adaptive excitation lag search is then carried out in the same manner as in the embodiment.

(c) Appropriate adaptive excitation lag is calculated by means of full search for all sections of extended adaptive codebook d_enh_ext[i], without prior selection of candidate values for adaptive excitation lag.

Moreover, whereas the present embodiment described a case where a search of the extended adaptive codebook d_enh_ext[i] is performed for all sub-frames targeted for encoding, the invention is not limited to such cases, it being possible for example, to perform a search of the extended adaptive codebook d_enh_ext[i] for only some of the sub-frames targeted for encoding within one frame. Specifically, in the case of ns=4, it would be acceptable to perform a search of the extended adaptive codebook d_enh_ext[i] for only the sub-frames is=0,2 targeted for encoding. In this way the increase in the number of encoded transmission bits of enhancement layer adaptive excitation lag can be moderated to some extent, while improving the sound quality of the scalable CELP-encoded speech signal.

Embodiment 2

Embodiment 2 in accordance with the present invention describes an embodiment wherein in the event that, in Embodiment 1, a difference in packet loss rate between packets that contain core layer encoded data transmitted wirelessly from speech encoding apparatus 100, and packets that contain enhancement layer adaptive excitation code should arise in speech decoding apparatus 200, adjustments will be made to the ratio of the gain value multiplied by the core layer excitation signals to the gain value multiplied by the adaptive excitation which is the output for the extended adaptive codebook. Specifically, in the event that in speech decoding apparatus 200 the loss rate of packets containing core layer encoded data is sufficiently lower than the loss rate of packets containing enhancement layer adaptive excitation code, during generation of enhancement layer excitation signals in speech encoding apparatus 100, the gain value multiplied by the core layer excitation signals will be increased or the gain value multiplied by the adaptive excitation will be reduced, in order to increase the effect of the core layer excitation signals over that of past enhancement layer excitation signals.

Figure 7:
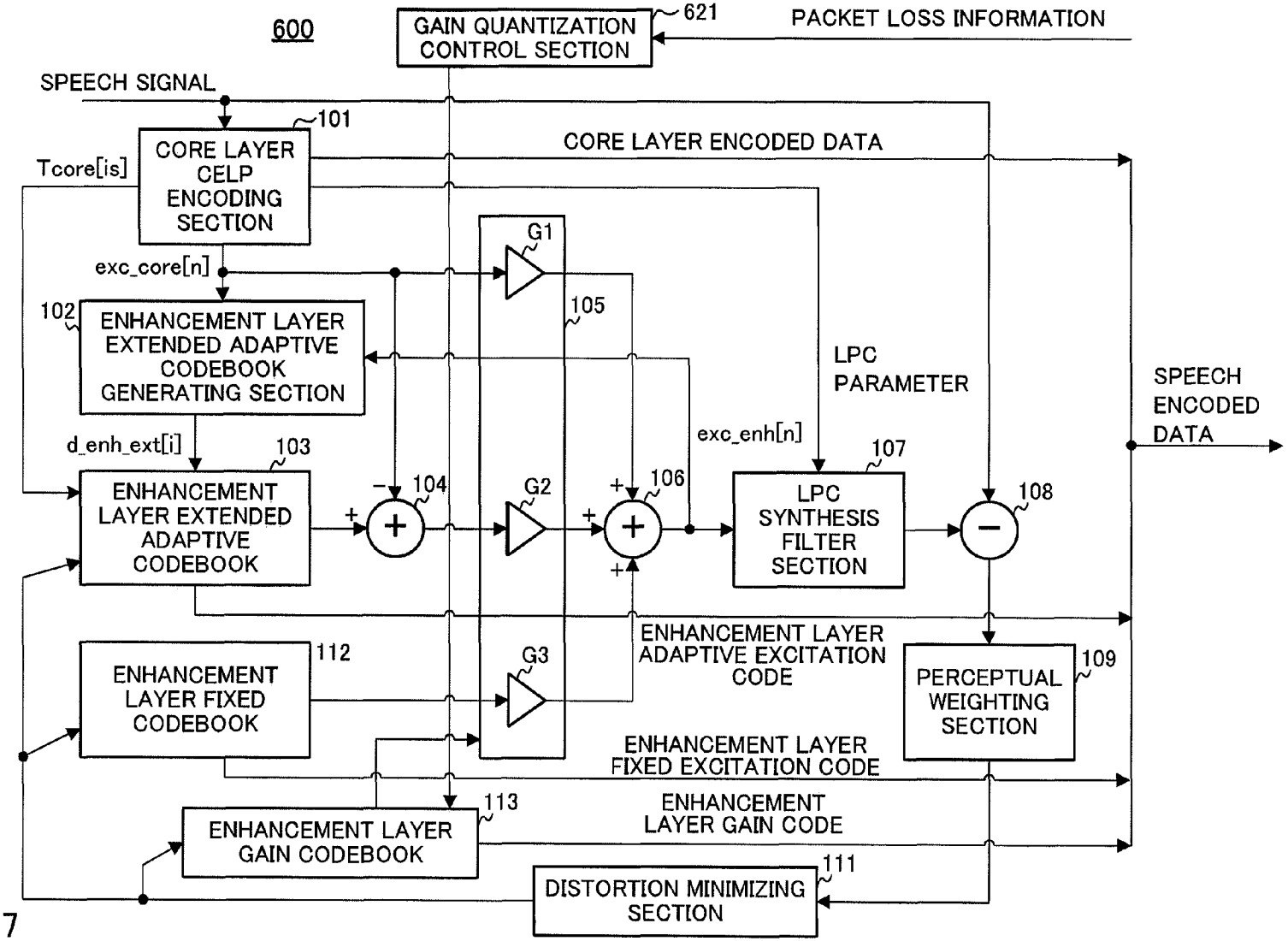
FIG. 7 is a block diagram showing a main of a speech encoding apparatus according to Embodiment 2.

FIG. 7 is a block diagram showing a main configuration of speech encoding apparatus 600 according to the present embodiment. Speech encoding apparatus 600 further comprises gain quantization control section 621 in speech encoding apparatus 100 in Embodiment 1. Accordingly, since speech encoding apparatus 600 has all of the elements of speech encoding apparatus 100, elements identical to elements of speech encoding apparatus 100 will be assigned the same reference numerals and the description thereof will be omitted. Speech encoding apparatus 600 is used installed in a mobile station or base station making up a mobile wireless communication system, to carry out packet communication with a wireless communications device equipped with speech decoding apparatus 200.

Gain quantization control section 621 acquires packet loss information created by speech decoding apparatus 200 in relation to packets containing core layer encoded data and packets containing enhancement layer adaptive excitation code previously transmitted by packet transmission from speech encoding apparatus 600; and adaptively controls gain values g1, g2, g3 according to this packet loss information. Specifically, where the loss rate of packets containing core layer encoded data is denoted by PLRcore and the loss rate of packets containing enhancement layer adaptive excitation code is denoted by PLRenh, gain quantization control section 621 establishes for the enhancement layer gain codebook 113 limits such as the following, in relation to gain value g1 for core layer excitation signals, and gain value g2 to be multiplied by differential signals of core layer excitation signals and the adaptive excitation output from the extended adaptive codebook; and carries out gain quantization under these limits.

if PLRcore<c*PLRenh then set the lower limit value that g1 can assume to THR1 set the upper limit value that g2 can assume to THR2 else upper limit and lower limit values for g1, g2 are not set Here, c is a constant for adjusting determination conditions relating to packet loss (with the proviso that c<1.0); THR1, THR2 are set value constants for the lower limit value for g1 and the upper limit value for g2.

In this way, by speech encoding apparatus 600 in accordance with the present embodiment, in the event that in speech decoding apparatus 200 the loss rate of packets containing core layer encoded data is sufficiently lower than the loss rate of packets containing enhancement layer adaptive excitation code, during generation of enhancement layer excitation signals in speech encoding apparatus 100, the gain value multiplied by the core layer excitation signals will be increased or the gain value multiplied by the adaptive excitation which is the output of extended adaptive codebook 103 will be reduced, whereby tolerance of packet loss for scalable CELP-encoded speech signals can be increased.

Speech encoding apparatus 600 according to the present embodiment may be implemented or modified in ways such as the following.

Whereas the embodiment described a case where gain quantization control section 621 sets limits for gain values g1, g2 in gain multiplying section 105, the present invention is not limited thereto, it being possible for example for gain quantization control section 621 to control enhancement layer extended adaptive codebook 103 in such a way that, during the extended adaptive codebook search, adaptive excitations are extracted preferentially from sections corresponding to core layer excitation signals, over sections corresponding to the conventional adaptive codebook. Furthermore, gain quantization control section 621 may also perform a combination of control of enhancement layer gain codebook 113 and control of enhancement layer extended adaptive codebook 103.

Additionally, whereas the present embodiment described a case where it is assumed that packet loss information is transmitted separately from the speech encoded data from speech decoding apparatus 200 to speech encoding apparatus 600, the present invention is not limited thereto, it being possible, for example, for speech encoding apparatus 600, upon receiving packets of speech encoded data transmitted wirelessly from speech decoding apparatus 200, to calculate the packet loss rate for the received packets, and to substitute its own calculated the packet loss rate for the packet loss rate in speech decoding apparatus 200.

Further, function blocks used in the explanations of the above embodiments are typically implemented as LSI constituted by an integrated circuit. These may be individual chips or partially or totally contained on a single tip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application in biotechnology is also possible.

The present application is based on Japanese Patent Application No. 2004-271886, filed on Sep. 17, 2004, the entire content of which is expressly incorporated by reference herein.

INDUSTRIAL APPLICABILITY

The speech encoding apparatus in accordance with the present invention can accurately estimate the excitation of sub-frames targeted for encoding, and as a result provides the advantage capable of improving sound quality of encoded speech signals, making it useful as a communications apparatus of a mobile station or base station making up a mobile wireless communications system.

The invention claimed is:

1. A speech encoding apparatus for performing a search of an adaptive codebook of an enhancement layer for each sub-frame in scalable CELP encoding of a speech signal, the speech encoding apparatus comprising:

a core layer encoding section that generates, for a core layer, a core layer excitation signal, and core layer encoded data that indicates an encoding result of CELP encoding, from the speech signal;

an enhancement layer extended adaptive codebook generating section that generates, for the enhancement layer, an extended adaptive codebook that includes an enhancement layer excitation signal preceding in time a sub-frame targeted for encoding, and a core layer excitation signal succeeding in time past enhancement layer excitation signals; and an enhancement layer extended adaptive codebook that generates an enhancement layer adaptive excitation code indicating an adaptive excitation vector for the sub-frame targeted for encoding by searching in the generated extended adaptive codebook.

2. The speech encoding apparatus according to claim 1, further comprising:

a transmitting section that transmits the core layer encoded data and the enhancement layer adaptive excitation code in individual packets;

a gain section that multiplies gain respectively for the core layer excitation signal and a signal indicating a characteristic of an adaptive excitation output from the enhancement layer extended adaptive codebook; and a gain controlling section that monitors a condition of packet loss of packets containing the core layer encoded data and of packets containing the enhancement layer adaptive excitation code transmitted by the transmitting section; and, in the event that a loss rate of packets containing the core layer encoded data is lower than a loss rate of packets containing the enhancement layer adaptive excitation code, increases, for the gain section, the gain multiplied by the core layer excitation signal or reduces the gain multiplied by the signal indicating a characteristic of the adaptive excitation.

3. The speech encoding apparatus according to claim 2, wherein the signal indicating a characteristic of the adaptive excitation is a differential signal between the adaptive excitation output from the enhancement layer extended adaptive codebook, and the core layer excitation signal.

4. A communication apparatus comprising the speech encoding apparatus according to claim 1.

5. A speech decoding apparatus for decoding scalable CELP-encoded speech data to generate decoded speech, the speech decoding apparatus comprising:

a core layer decoding section that decodes, for a core layer, encoded core layer data included in speech encoded data, and generates a core layer excitation signal and a decoded core layer speech signal;

an enhancement layer extended adaptive codebook generating section that generates, for an enhancement layer, an extended adaptive codebook that includes an enhancement layer excitation signal preceding in time a sub-frame targeted for decoding and a core layer excitation signal succeeding in time past enhancement layer excitation signals; and an enhancement layer extended adaptive codebook that extracts from the generated extended adaptive codebook an adaptive excitation vector for the sub-frame targeted for decoding.

6. A communication apparatus comprising the speech decoding apparatus according to claim 5.

7. A speech encoding method for carrying out, in scalable CELP encoding of a speech signal, an adaptive codebook search of an enhancement layer for a sub-frame, the method comprising:

generating, for a core layer, a core layer excitation signal, and core layer encoded data indicating an encoding result of CELP encoding, from the speech signal;

generating, for the enhancement layer, an extended adaptive codebook that has an enhancement layer excitation signal preceding in time a sub-frame targeted for encoding, and a core layer excitation signal succeeding in time past enhancement layer excitation signals; and generating an enhancement layer adaptive excitation code that indicates an adaptive excitation vector of the sub-frame targeted for encoding by searching in the extended adaptive codebook.

* * * * *